US005967507A

United States Patent [19]

Moore et al.

[11] Patent Number: 5,967,507

[45] Date of Patent: Oct. 19, 1999

[54] AUTOMATIC DOCUMENT HANDLER HAVING NON-RELATIVE MOTION VACUUM CORRUGATING DEVICE

[75] Inventors: Kenneth P. Moore, Rochester; Raymond C. Bassett, Webster, both of N.Y.

[73] Assignee: Xerox Corporation, Stamford, Conn.

[21] Appl. No.: 08/833,216

[22] Filed: Apr. 14, 1997

[51] Int. Cl.[6] ..... B65H 3/14; B65H 3/08; B65H 3/04

[52] U.S. Cl. ..... 271/94; 271/98; 271/99; 271/35; 271/104

[58] Field of Search ..... 271/94, 98, 99, 271/35, 3.07, 104, 11, 12, 20, 106

[56] References Cited

U.S. PATENT DOCUMENTS

| | | | |
|---|---|---|---|
| 3,322,301 | 5/1967 | Bliss | 221/36 |
| 4,231,562 | 11/1980 | Hori | 271/3.1 |
| 4,305,576 | 12/1981 | Hamlin | 271/11 |
| 4,336,929 | 6/1982 | Hanzlik | 271/35 |
| 4,411,417 | 10/1983 | Browne | 271/94 |
| 4,660,819 | 4/1987 | Allocco et al. | 271/3.01 |
| 4,678,176 | 7/1987 | Roller | 271/34 |
| 4,813,660 | 3/1989 | Dodd et al. | 271/20 |
| 4,968,017 | 11/1990 | Depetris | 271/146 |
| 5,071,110 | 12/1991 | Arnone et al. | 271/104 |
| 5,199,660 | 4/1993 | Smith | 226/171 |
| 5,607,146 | 3/1997 | Novick | 271/279 |
| 5,829,740 | 11/1998 | Kerpe | 271/197 |

*Primary Examiner*—Donald P. Walsh
*Assistant Examiner*—Daniel K Schlak
*Attorney, Agent, or Firm*—Tallam I. Nguti

[57] ABSTRACT

An automatic document handler having a sheet separator-feeder mechanism for separating a sheet from a stack of such sheets and for forward feeding the separated sheet without damage to an image on the sheet. The automatic document handler includes a stacking tray having a surface for supporting a stack of sheets; air knife means positioned opposite the stack of sheets for separating a sheet at an end of the stack of sheets, and a sheet separator-feeder mechanism including a bi-level support plate having vacuum ports. The sheet separator-feeder mechanism is mounted toward the downstream end of the stacking tray relative to a direction of forward sheet movement, and applies a negative air pressure through the vacuum ports in the support plate. The sheet separator-feeder mechanism importantly includes a non-relative motion sheet corrugating device comprising an endless corrugating feed belt that is mounted over the support plate and extends through at least a front end of the sheet stacking tray for acquiring, corrugating and advancing a sheet separated from the stack of sheets. The endless corrugating feed belt has a bottom surface for riding on the support plate, a top surface for contacting a sheet to be corrugated and fed, and a series of vacuum apertures formed therethrough from the bottom to the top surface. The top surface importantly includes a raised corrugating rib integrally incorporated therein for contacting, moving with, and corrugating the sheet separated from the stack of sheets, without relative motion between the corrugating rib and the sheet, thereby preventing damage to any image on a side of the sheet in contact with the endless corrugating belt.

4 Claims, 3 Drawing Sheets

AUTOMATIC DOCUMENT HANDLER HAVING NON-RELATIVE MOTION VACUUM CORRUGATING DEVICE

BACKGROUND

The present invention relates to electrostatographic reproduction machines, and more particularly to an automatic document handler for use therewith that includes a sheet separator-feeder mechanism having a non-relative motion vacuum corrugating device which effectively prevents damage to images on document sheets being separated and fed thereby.

Generally, the process of electrostatographic production or reproduction of an image on a sheet of material is initiated by exposing a light image of an original image document onto a substantially uniformly charged photoreceptive member. The original image document may be manually placed, in registration, at an exposure station for such exposure, or it may be fed automatically by an automatic document handling device, also in registration, to the exposure station. Exposing the light image onto the charged photoreceptive member discharges areas of a photoconductive surface thereof corresponding to non-image areas in the original document, while maintaining the charge in image areas, thereby creating an electrostatic latent image of the image of the original document on the photoreceptive member.

Thereafter, developing material including charged toner particles is deposited onto the photoreceptive member such that the charged toner particles are attracted to the image areas on the photoconductive surface to develop the electrostatic latent image into a visible image. This developed image is then transferred from the photoreceptive member, either directly or after an intermediate transfer step, to an image receiving support substrate, such as a copy sheet of paper, thus creating a toner image on the support substrate corresponding to the original image of the original document. The image receiving support substrate, such as a copy sheet of paper, typically is fed automatically from a supply source, and in timed registration, to an image transfer station for receiving the toner image as such. Subsequently, the transferred image is typically fused and affixed to the image support substrate to form a permanent image thereon. In a final step, the photoconductive surface of the photoreceptive member is cleaned to remove any residual developing material thereon in preparation for successive imaging cycles.

It is known to employ in such an electrostatographic reproduction machine, an automatic document handler or handling apparatus as disclosed for example in U.S. Pat. No. 5,071,110. In such a machine, the automatic document handler automatically transports or feeds document sheets, one at a time, from a stack thereof to a registered position at an exposure station of the machine. With the advent of high speed electrostatographic reproduction machines, such an automatic document handler thereon must handle sets of simplex and duplex original image documents as above, for producing copies thereof at a rate in excess of a hundred simplex copies per minute. Usually, handling document sheets effectively at such speeds requires the use of a vacuum corrugating sheet separating and feeding device as disclosed for example, in U.S. Pat. No. 4,231,562; U.S. Pat. No. 4,305,576; U.S. Pat. Nos. 4,411,417 and 5,071,110.

For example, U.S. Pat. No. 4,305,576 discloses a typical vacuum separating and feeding system wherein a plurality of friction belts is arranged to run over a vacuum plenum placed at the bottom of a sheet supply tray which has a "U" shaped pocket formed in it. The pocket serves to provide space for the bottom sheet to be captured by the vacuum feed belt assembly, to provide an air seal between the bottom sheet and the edges of the pocket and to provide a high pressure seal between the bottom sheet and the remainder of the stack. This high pressure seal is achieved by supporting a major portion of the stack weight on the edge regions of the pocket.

In U.S. Pat. No. 4,411,417, the bottom sheet vacuum corrugation feeder includes a differently designed stack support tray that has a planar base portion defining a base plane, the front of the base portion having an opening within which the bottom sheet separator is positioned. The tray also includes two sloping planar side wings, one at each side of the opening in the base portion. The sloping planar side wings are angled upward from the base plane and are angled outward from front to rear of the tray and intersect the base plane such that the intersection at the rear of the tray is in the approximate location of the rear corners of a rectangle the size of a sheet to be fed.

Typically, such prior art is directed to devices including top or bottom sheet vacuum corrugation feeder trays which are used in combination with vacuum transport devices. Air injection means are provided to inject air between a sheet at end of the stack (top or bottom) and the remainder of a stack. A fixed position raised portion or corrugating member in the center of a vacuum plenum imparts a corrugation, that is, for example, U-shape, to a sheet when the sheet is pulled off the stack by a vacuum.

However, it has been found in some cases that original images on document sheets are damaged by such document sheet handling devices due to relative motion between the pulled off document sheet and the corrugating member, thus ordinarily resulting in poor quality copies.

Since the documents must be handled gently but positively to assure separation without damage through a number of cycles, a number of solutions have been suggested such as a separator-feeder mechanism that has a center belt which runs over the top of a fixed position corrugator or corrugating member. Such an arrangement with a fixed position corrugating member, is partially effective by eliminating relative motion between the belt and the sheet, however, it importantly does not eliminate relative motion between the corrugating member and the sheet. Additionally, such an arrangement has several other disadvantages such as the belt tending to wear relatively more rapidly due to the concentrated drag over the fixed position raised corrugator, and such as the belt tending to "dampen" the affect of the corrugator. In addition, the amplitude and shape of the corrugation on the sheet is limited by the ability of the belt which must track over the corrugator.

SUMMARY OF THE INVENTION

In accordance with the present invention, there is provided an automatic document handler having a sheet separator-feeder mechanism for separating a sheet from a stack of such sheets and for forward feeding the separated sheet without damage to an image on the sheet. The automatic document handler includes a stacking tray having a surface for supporting a stack of sheets; air knife means positioned opposite the stack of sheets for separating a sheet from an end of the stack of sheets, and a sheet separator-feeder mechanism including a bi-level support plate having vacuum ports. The sheet separator-feeder mechanism is mounted toward the downstream end of the stacking tray relative to a direction of forward sheet movement. The sheet separator-feeder mechanism applies a negative air pressure through the vacuum ports in the support plate. The sheet separator-feeder mechanism importantly includes a non-relative motion sheet corrugating device comprising an endless corrugating feed belt that is mounted over the support plate and that extends through at least a front end of the sheet stacking tray for acquiring, corrugating and advancing a sheet separated from the stack of sheets. The endless corrugating feed belt has a bottom surface for riding on the support plate, a top surface for contacting a sheet to be corrugated and fed, and a series of vacuum apertures formed therethrough from the bottom to the top surface. The top surface includes a raised corrugating rib integrally incorporated therein for contacting, moving with, and corrugating the sheet separated from the stack of sheets, without relative motion between the corrugating rib and the sheet, thereby preventing damage to any image on a side of the sheet in contact with the endless corrugating belt.

BRIEF DESCRIPTION OF THE DRAWINGS

In the detailed description of the invention presented below, reference is made to the drawings, in which.

DESCRIPTION OF THE INVENTION

Figure 1:
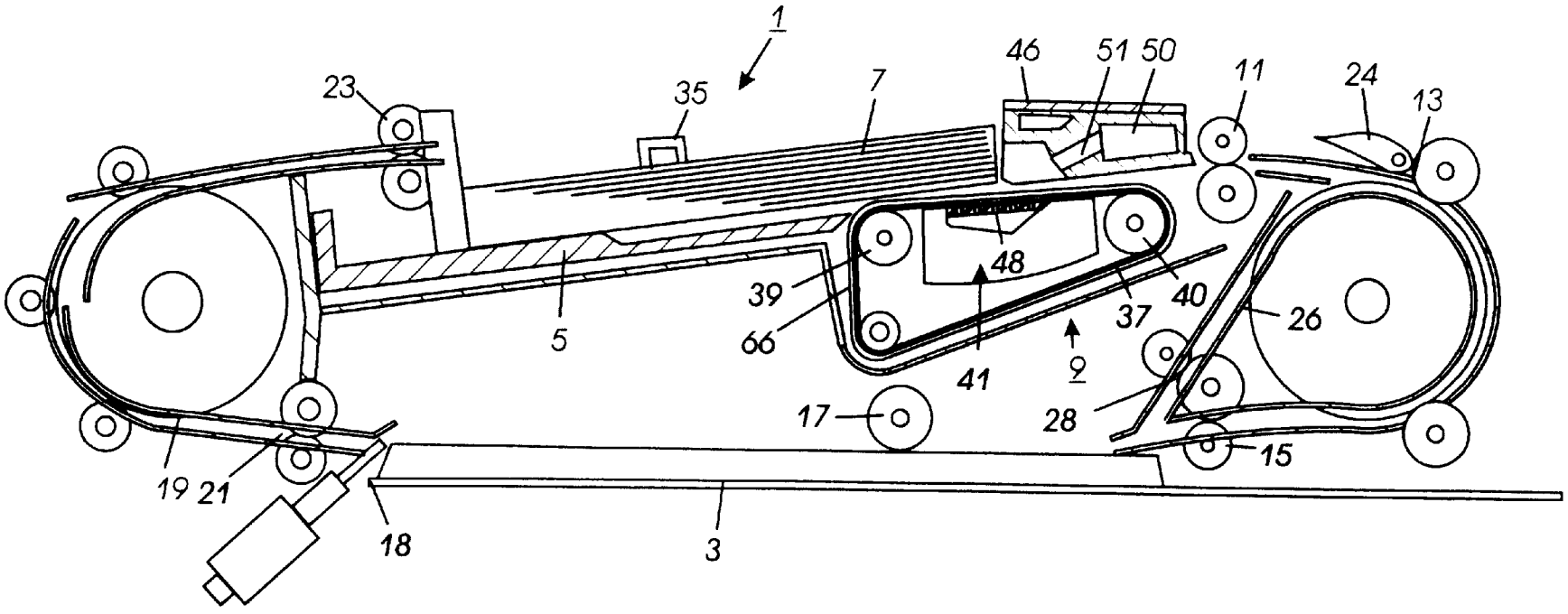
FIG. 1 is a cross sectional side view of an automatic document handler including an exemplary sheet separator-feeder mechanism employing the corrugating feed belt of the present invention.

Referring now to FIG. 1, there is illustrated an exemplary automatic document feeder 1, that includes a sheet separator-feeder mechanism 9 of the present invention, for installation over the exposure platen 3 of a conventional xerographic reproduction machine. This is merely one example of a document handler with which the sheet separator-feeder mechanism of the present invention may be combined. As shown, the document handler 1 is provided with a document tray 5 for supporting a stacked set 7 of document sheets. The sheet separator-feeder mechanism 9 of the present invention is located below the front or forward area of the document tray 5 for acquiring and corrugating, without relative motion, the bottom document sheet in the stack 7, and for feeding out that document sheet to take-away roll pair 11 without damage to any image on the document sheet.

The acquired sheet is fed through document guides 13 to a feed-roll pair 15, and under platen roll 17, onto a platen 3 of a copy machine for reproduction. A retractable registration edge 18 is provided here for registering the lead edge of the document sheet being fed onto the platen. Following exposure of a first side of the document sheet, the registration edge 18 is retracted by suitable means such as by a solenoid, and thus allowing the document sheet to be fed off the platen 3, for example, by roll 17. The document sheet is fed as such onto a guide 19 and feed-roll pair 21. From there it is returned to the top of the stack of document sheets on the document tray 5, through a feed-roll pair 23.

There are, of course, cases when it is desirable to refeed from the stack of document sheets in order to present the second and opposite side of each document sheet for exposure. In each such case, the document sheets are again fed one at a time from the stack 7 through guides 13 until the trail edge thereof passes through a document diverter 24. Document diverter 24 is then rotated counterclockwise for example, i.e., into the document sheet path. The initial document sheet direction of movement is reversed and the document sheet is diverted by diverter 24 through guides 26 and feed-roll pair 28, onto the platen 3.

The document handler 1 is also provided with a sheet separator finger 35 as is well known in the art, to sense and indicate, in other words separate, those document sheets yet to be fed, as distinguished from those documents that have been fed and returned to the stack. Such separation enables the document handler to count each set of document sheets being circulated, for control purposes. Upon the feeding of the last document sheet from beneath the stack, the sheet separator finger 35 drops through a slot provided in the tray 5, and actuates a suitable sensor indicating that the last document sheet in the stack has been fed from the tray. The finger 35 is then automatically rotated in a clockwise direction or otherwise lifted, to again come to rest on top of all the documents in the stack 7, for the start of the next recirculation of the document stack 7.

Figure 2:
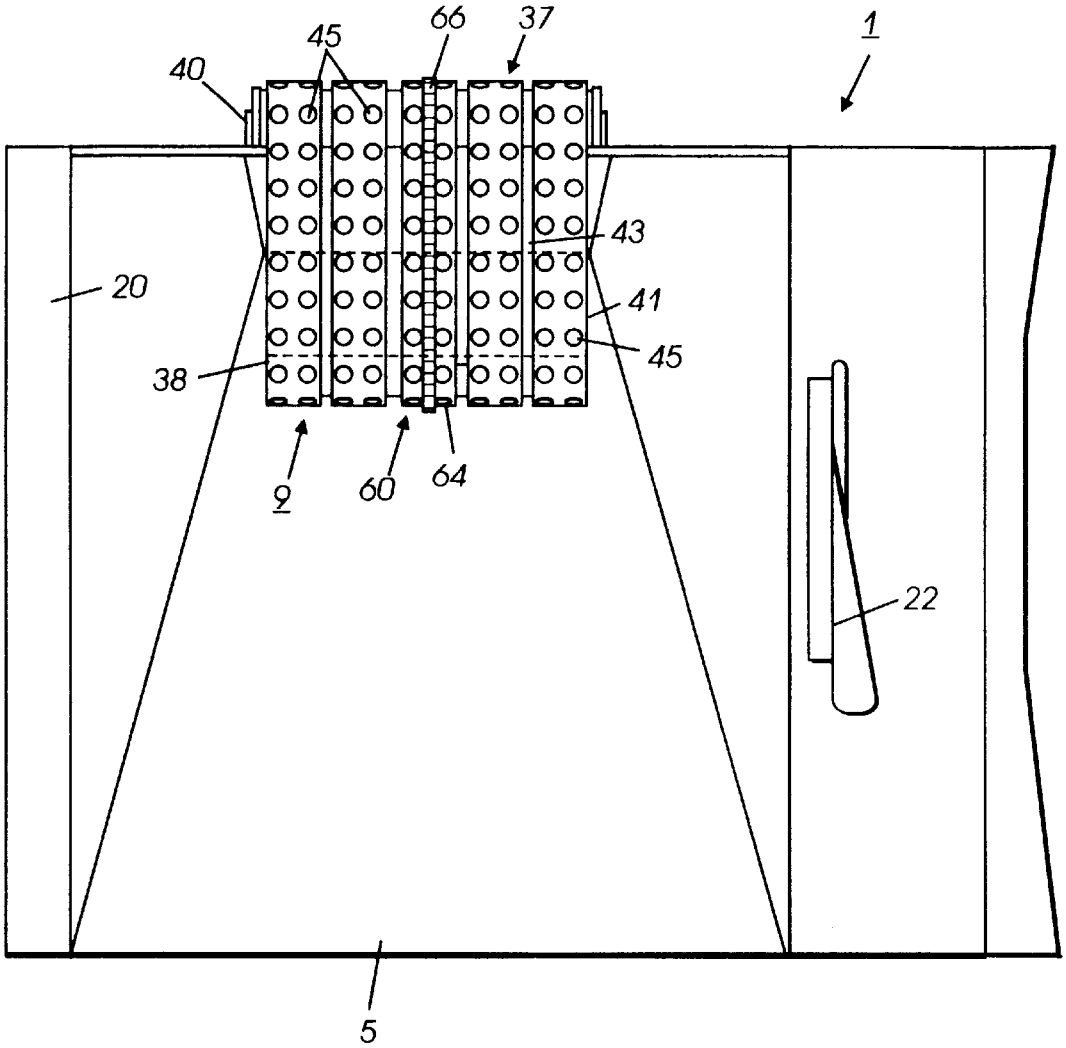
FIG. 2 is a plan view of the automatic document handler of FIG. 1, showing the sheet stacking tray and sheet separator-feeder mechanism in accordance with the present invention.
Figure 3:
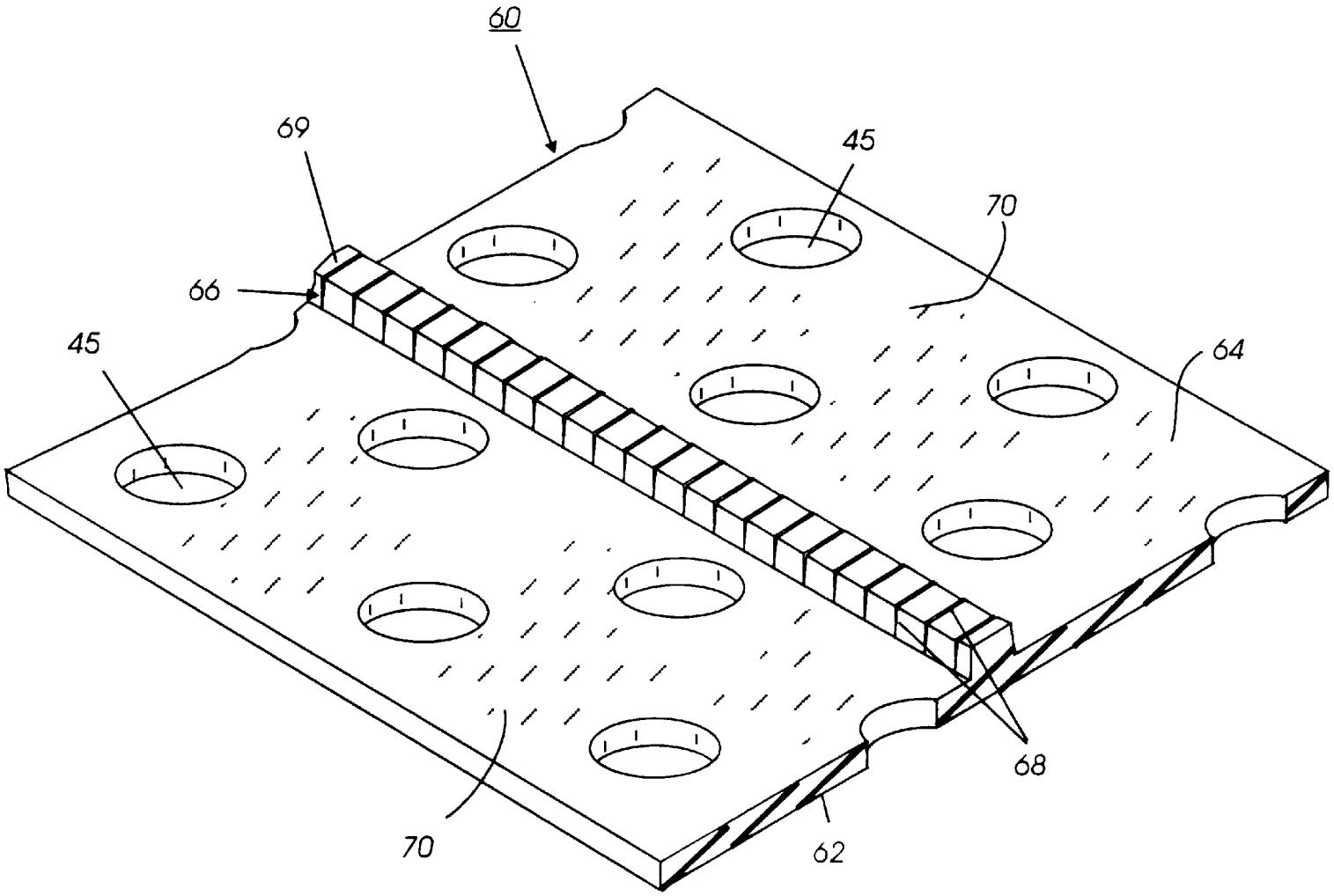
FIG. 3 is a perspective illustration of a portion of the ribbed corrugating feed belt of the separator-feeder mechanism of the present invention.

Referring particularly to FIGS. 2 to 4 and as disclosed above, the automatic document handler 1 of the present invention includes the stacking tray 5 having a surface for supporting the stack 7 (FIG. 1) of sheets; air knife means 46 positioned opposite the stack 7 of sheets for separating a sheet at an end (for example, the bottom end, but it could also be the top end for a top feeder) of the stack of sheets. The automatic document handler 1 also includes the separator-feeder mechanism 9 that has a support plate 48 including vacuum ports 43, and that is mounted downstream of the stacking tray 5 relative to a direction of forward movement of the sheet, for applying a negative air pressure through vacuum ports 43 in the support plate.

As shown, the separator-feeder mechanism 9 importantly includes an endless corrugating feed belt 60 of the present invention, that is mounted over the support plate 48, and extends through at least a front end of the sheet stacking tray 5 for acquiring and advancing a sheet separated from the stack of sheets, without damage to any image on the document sheet. As illustrated, FIGS. 1 to 3, the endless corrugating feed belt 60 has a bottom surface 62 for riding on the support plate 48, a top surface 64 for contacting a sheet to be corrugated and fed, and a series of vacuum apertures 45 formed therethrough from the bottom to the top surface. The top surface 64 advantageously includes a raised corrugating rib 66 that is integrally incorporated therein for contacting, moving with, and corrugating the sheet separated from the stack of sheets, without relative motion between the corrugating rib 66 and the sheet, thereby preventing damage to any image on a side of the sheet in contact with the endless corrugating belt. As further shown (FIG. 3), the corrugating feed belt 60 is preferably a single wide belt, and the corrugating rib 66 runs continuously and circumferentially around the top surface 64 thereof.

In the sheet separator-feeder mechanism 9, the endless corrugating feed belt 60 preferably is one of a set or series of belts 37 supported for movement on feed belt rolls 39 and 40. Spaced within the run of the belts 37 there is provided a vacuum plenum 41 defined by the support plate 48 which has openings 43 therein. The openings 43 are adapted for cooperation with perforations 45 of about 3 mm in each of the belts 37 in order to provide a vacuum for pulling the bottom document sheet in the document stack 7 onto the belts 37. In accordance with the present invention, the corrugating rib or corrugating member 66 is incorporated only into the one belt 60 of the set of belts 37, with the rest of the belts being non-corrugating belts. However, such a rib could also be incorporated in each of the other belts of the set 37.

In operation, a blower (not shown) generates a slight vacuum to attract a document sheet from the stack 7 to the feed belts 37, and to the non-relative motion corrugating feed belt 60. The feed belts 37 are clutched for example to an AC motor (not shown). Energizing the clutch (not shown) starts the sheet in motion towards a pair of nip forming Take Away Rolls 11 (FIG. 1). Because light sheets have very little beam strength, feeding a sheet as such is ordinarily tantamount to "pushing a rope". Therefore, it is necessary and preferable, as disclosed above, to corrugate the sheet. Conventionally, a fixed position corrugator or corrugating member would be used between or under the belts 37, such that the sheet moves relative to this corrugator or corrugating member. As pointed out above, this undesirably can result in damage to an image on such sheet, or to the sheet itself, and hence to relatively poor quality copies, particularly when such a sheet is repeatedly recirculated and fed, each time being subjected to such relative motion.

The one belt 60 includes the raised rib 66 so that upon capture of the bottom document sheet from the stack 7 against the belts 37, a corrugation will be developed in the sheet by the rib 66, thereby enhancing separation of the sheet from the rest of the stack. This separation is due in part to a corrugation gap placed in the sheet which allows for entry of separating air flow from an air knife 46. The air knife 46 is comprised of a pressurized air plenum 50 having a plurality of separated air orifices 51 to inject air between the bottommost document pulled down against the feed belts 37 and the documents in the stack thereabove, thus providing an air cushion or bearing between the stack and the bottom document. This minimizes the force needed for removing the bottom document from the stack 7.

By suitable valving and controls, it is desirable to provide a delay between the time vacuum is applied to pull the document sheet onto the feed belts 37, and a start up of the feed belts, in order to assure that the bottom document sheet is effectively captured onto the belts 37 before belt movement commences. Such delay also allows time for the air knife 46 to separate the bottom sheet from any sheets that were pulled down with it.

Because the bending moment of inertia of the belt 60 will be increased due to the raised corrugating rib 66, periodic slits 68 preferably are formed partially into a raised portion 69 of the rib 66, and in the crossprocess direction. Such slitting can be performed during the manufacturing process, and advantageously function to reduce belt drive torque around bends, without any detrimental effects to the belt 60. As with any such vacuum belt, a knurl pattern 70 preferably is formed on the top surface 64 for extending the vacuum pressure between belt holes 45 and near the corrugating rib 66.

To recapitulate, the present invention discloses an automatic document handler having a sheet separator-feeder mechanism for separating a sheet from a stack of such sheets and for forward feeding the separated sheet without damage to an image on the sheet. The automatic document handler includes a stacking tray having a surface for supporting a stack of sheets; air knife means positioned opposite the stack of sheets for separating a sheet at an end of the stack of sheets, and a sheet separator-feeder mechanism including a bi-level support plate having vacuum ports.

The sheet separator-feeder mechanism is mounted toward the downstream end of the stacking tray relative to a direction of forward sheet movement. The sheet separator-feeder mechanism applies a negative air pressure through vacuum ports in the support plate. The sheet separator-feeder mechanism importantly includes a non-relative motion sheet corrugating device comprising an endless corrugating feed belt that is mounted over the support plate and extends through at least a front end of the sheet stacking tray for acquiring, corrugating and advancing a sheet separated from the stack of sheets.

The endless corrugating feed belt has a bottom surface for riding on the support plate, a top surface for contacting a sheet to be corrugated and fed, and a series of vacuum apertures formed therethrough from the bottom to the top surface. The top surface includes a raised corrugating rib integrally incorporated therein for contacting, moving with, and corrugating the sheet separated from the stack of sheets, without relative motion between the corrugating rib and the sheet, thereby preventing damage to any image on a side of the sheet in contact with the endless corrugating belt.

The separator-feeder mechanism further includes an equal number of non-corrugating endless feed belts mounted over the support plate, and to each side of the endless corrugating feed belt. The corrugating rib includes a raised portion and a series of repeated cross-slits cut partially into the raised portion for reducing stress on the raised portion being moved around a bend. Furthermore, the corrugating belt and each of the non-corrugating belts includes a knurl pattern on a top surface thereof for enhancing effectiveness of a holding vacuum applied to a sheet thereon.

While the embodiment disclosed herein is preferred, it will be appreciated from this teaching that various alternative, modifications, variations or improvements therein may be made by those skilled in the art, which are intended to be encompassed by the following claims:

What is claimed is:

1. An automatic document handler for separating a sheet from a stack of such sheets and for forward feeding the separated sheet without damage to an image on the sheet, the automatic document handler comprising:

(a) a stacking tray having a surface for supporting a stack of sheets;

(b) air knife means positioned opposite the stack of sheets for separating a sheet at an end of the stack of sheets; and (c) a sheet separator-feeder mechanism mounted toward a downstream side of said stacking tray relative to a direction of forward sheet movement, said sheet separator-feeder mechanism including a bi-level support plate having vacuum ports for applying a negative air pressure through said support plate, and a non-relative-motion sheet corrugating device, said non-relative-motion sheet corrugating device comprising an endless corrugating feed belt mounted for movement over said support plate and extending through at least a front end of said stacking tray, for acquiring, corrugating and advancing a sheet separated from the stack of sheets, said endless corrugating feed belt having a bottom surface for riding on said support plate, a top surface for contacting a sheet to be corrugated and fed, and a series of vacuum apertures formed therethrough from said bottom to said top, and said top surface including a raised corrugating rib integrally incorporated therein for contacting and corrugating the sheet separated from the stack of sheets, said corrugating rib moving with the sheet separated from the stack of sheets and without relative motion between said corrugating rib and the sheet, thereby preventing damage to any image on a side of the sheet in contact with said endless corrugating belt.

2. The automatic document handler of claim 1, including an equal number of non-corrugating endless feed belts mounted to each side of said endless corrugating feed belt and over said support plate.

3. The automatic document handler of claim 1, wherein said corrugating rib of said endless corrugating feed belt includes a series of repeated cross-slits cut partially into said raised portion for reducing stress on said raised portion being moved around a bend.

4. The automatic document handler of claim 2, wherein said corrugating feed belt and each of said non-corrugating feed belts includes a knurl pattern on a top surface thereof for enhancing effectiveness of a vacuum applied to a sheet thereon.

* * * * *